US007111437B2

(12) United States Patent
Ainedter

(10) Patent No.: US 7,111,437 B2
(45) Date of Patent: Sep. 26, 2006

(54) APPARATUS FOR MAKING BRICK WALL ELEMENTS

(76) Inventor: Dieter Ainedter, Kreuzbergpromenade 49, A-5026 Salzburg (AT)

( * ) Notice: Subject to any disclaimer, the term of this patent is extended or adjusted under 35 U.S.C. 154(b) by 402 days.

(21) Appl. No.: 10/173,128

(22) Filed: Jun. 17, 2002

(65) Prior Publication Data

US 2003/0229998 A1 Dec. 18, 2003

(51) Int. Cl.
*E04G 21/14* (2006.01)

(52) U.S. Cl. ..... 52/749.14; 52/DIG. 1; 52/799.13; 414/10; 414/626; 414/792.9; 414/751.1; 156/579

(58) Field of Classification Search ..... 52/749.14, 52/749.13, 747.1, DIG. 1; 33/410, 527, 404; 156/297, 558, 579, 575; 118/315, 411, 412; 222/611.2; 414/10, 626, 792.9, 751.1
See application file for complete search history.

(56) References Cited

U.S. PATENT DOCUMENTS

| | | | | | |
|---|---|---|---|---|---|
| 3,790,428 | A | | 2/1974 | Lingl | |
| 3,930,929 | A | | 1/1976 | Lingl | |
| 3,990,934 | A | | 11/1976 | Lingl | |
| 4,060,955 | A | * | 12/1977 | Lachnit | 52/749.14 |
| 4,067,766 | A | * | 1/1978 | Larger | 156/297 |
| 4,094,118 | A | * | 6/1978 | Lingl, Sr. | 52/747.12 |
| 4,829,737 | A | * | 5/1989 | Anliker | 52/749.14 |
| 5,016,419 | A | * | 5/1991 | Boot et al. | 52/749.14 |
| 5,018,923 | A | * | 5/1991 | Melan et al. | 414/10 |
| 5,284,000 | A | * | 2/1994 | Milne et al. | 52/749.14 |
| 6,370,837 | B1 | * | 4/2002 | McMahon et al. | 52/749.14 |

FOREIGN PATENT DOCUMENTS

| | | |
|---|---|---|
| DE | 2211542 | 7/1973 |
| DE | 2333709 | 5/1974 |
| DE | 198 30 985 | 1/1999 |

* cited by examiner

*Primary Examiner*—Carl D. Friedman
*Assistant Examiner*—Chi Q. Nguyen
(74) *Attorney, Agent, or Firm*—Flynn, Thiel, Boutell & Tanis, PC

(57) ABSTRACT

For producing wall panels (8) from bricks (1), a line-up path (4) on which bricks to be masoned are deposited in a row with a gripper, a transfer device (10) for transporting the brick row from the line-up path (4) to a bricklaying station (7) for masoning the wall panel, and a device for moving apart the bricks to form vertical joints (9) between the bricks (1) of the wall panel (8) are provided. The gripper depositing the bricks (1) on the line-up path (4) is formed by a depiling gripper (3) that depiles the bricks (1) of a pile (2) in rows with its two longitudinal grippers (13, 14). The device for moving apart the bricks (1) is formed by transverse grippers (21, 21*a*) disposed on the depiling gripper (3) between the longitudinal grippers (13, 14), said transverse grippers (21, 21*a*) individually holding the bricks (1) of the brick row depiled with the longitudinal grippers (13, 14) and being formed to be movable in the longitudinal direction of the depiling gripper (3).

14 Claims, 2 Drawing Sheets

APPARATUS FOR MAKING BRICK WALL ELEMENTS

This invention relates to an apparatus for producing wall panels according to the generic part of claim 1.

Such an apparatus is known from DE 198 30 985 A1. Bricks to be masoned are placed by a gripper on a line-up path formed as an endless conveyor that conveys them in groups in a row against a stop. The actual length of the groups of bricks thus pushed together in abutting relationship is determined with a light barrier disposed on the endless conveyor. The device for moving apart the bricks is formed by the transfer device for transporting the particular group of bricks from the line-up path to the bricklaying station for them to be masoned into the wall panel on a mortar bed on the lower brick row there. The transfer device is formed as a row gripper whose individual grippers are guided movably via individually driven pinions along a rack.

The bricks to be masoned have different lengths due to production-related tolerances. The tolerance deviations of the bricks can be compensated with such an apparatus by vertical joints of varying width. Further, a raw brick wall, a so-called fair-faced wall, can be produced with an optically appealing joint width. However, the productive capacity of the known apparatus leaves something to be desired.

This is because bricks are first removed from a pallet stack here, then deposited on a conveying device and conveyed in groups against a stop. After measurement of the length of a group of e.g. three bricks, the latter are then gripped again, pulled apart to size and deposited at their position in the wall (by a gripper traveling in the direction of the wall).

The problem of the invention is therefore to clearly increase the productive capacity of such an apparatus.

This is obtained according to the invention by the apparatus characterized in claim 1. Subclaims 2 to 7 render advantageous embodiments of the invention. Claim 8 is directed to the preferred use of the inventive apparatus for producing wall panels for fair-faced walls.

According to the invention, the pile gripper has longitudinal grippers for gripping a brick row of a brick pile and pushing it together into a block in the longitudinal direction, and transverse grippers for individually gripping each single brick of a brick row. The transverse grippers are adapted to travel in the longitudinal direction of the pile gripper for moving apart the bricks of a depiled, gripped brick row.

The brick row can accordingly first be gripped from the brick pile by the longitudinal grippers while the transverse grippers are moved apart and open. Regripping is done in the air. The transverse grippers grab while the longitudinal grippers are being moved apart. In this gripping position the transverse grippers can then be moved apart in the longitudinal direction of the pile gripper for accordingly aligning the bricks.

The depiling gripper preferably has a measuring device integrated therein for measuring the actual length of the depiled brick rows, and a positioning apparatus for moving apart the bricks of the brick row gripped by the transverse grippers to the nominal length.

The measuring device expediently detects the distance between the longitudinal grippers that corresponds to the length of the gripped brick row while the latter is gripped by the depiling gripper.

A pile gripper is preferably adapted to travel from the delivery station where the brick piles are deposited to the line-up path.

The line-up path is preferably formed by a conveyor, which can be formed for example as a transport belt or similar endless conveyor or roller conveyor.

Alternatively, for processing suitable bricks made e.g. of chalky sandstone instead of brick material, the transverse grippers can be equipped with vacuum suction means and formed only on one side.

In the following the invention will be explained in more detail by way of example with reference to the enclosed drawing, in which.

Figure 1:
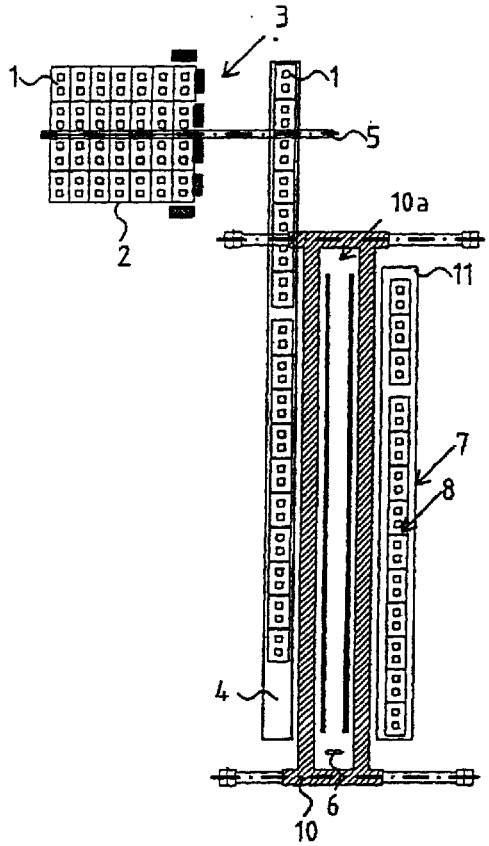
FIG. 1 shows schematically the plan view of an apparatus for producing wall panels from bricks.

According to FIG. 1, bricks 1 to be processed are delivered in the form of palletized brick piles 2. Bricks 1 of pile 2 are deposited with depiling gripper 3 on line-up path 4. Depiling gripper 3 is adapted to travel along guide 5 extending across one end of line-up path 4.

Line-up path 4 is formed as a conveyer belt, roller conveyor or similar conveyor for lining up bricks 1 to be masoned deposited by depiling gripper 3 along line-up path 4 in a predetermined number, at the distance apart as deposited by depiling gripper 3.

Bricks 1 lined up on line-up path 4 are transported with transfer device 10 with gripper 10*a* shown schematically in the direction of arrow 6 to brick-laying station 7 disposed parallel to line-up path 4, where wall panel 8 is masoned.

The first brick row on line-up path 4 is deposited for this purpose on base 11 provided at brick-laying station 7. A mortar bed is applied and then the second wall row from line-up path 4 placed on with transfer device 6, and so on, until wall panel 8 has been masoned to the predetermined height.

For masoning a fair-faced wall, vertical joints 9 between bricks 1 of wall panel 8 are to have a certain width so as to be mortared perfectly.

According to the invention, bricks 1 are for this purpose depiled from brick pile 2 in rows with depiling gripper 3, then moved apart to the desired joint width with depiling gripper 3 and deposited on the conveyor of line-up path 4 so that a joint of equal width also forms between the last brick of the next to last deposited depiled brick row and the first brick of the last deposited brick row. The last deposited brick row is thus moved on with the conveyor by the measure of its length plus one joint width.

Figure 2:
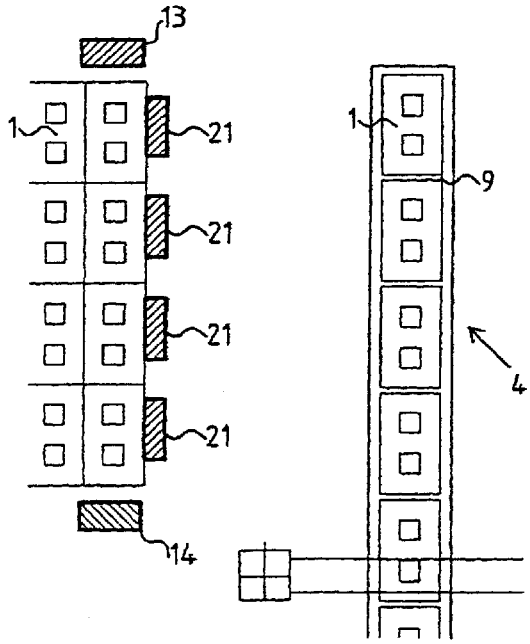
FIG. 2 shows an enlarged representation of the plan view according to FIG. 1 in the area of the brick pile and the line-up path.
Figure 3:
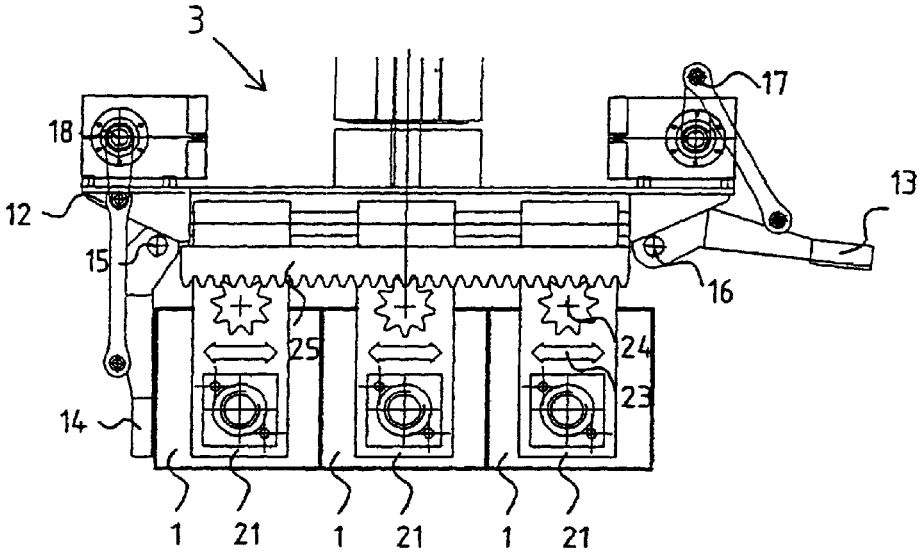
FIG. 3 shows a side view of the depiling gripper.

According to FIG. 3, pile gripper 3 has a pair of grippers 13, 14 that grips a brick row of brick pile 1. Each brick row can consist of three bricks 1 as shown in FIG. 2, or of e.g. four according to FIG. 1. Longitudinal grippers 13, 14 are hinged to carrier 12 of depiling gripper 3 to swivel about axle 15, 16 above bricks 1 and are actuated by crank mechanism 17, 18. Longitudinal grippers 13, 14 are thus used to remove a whole brick row from brick pile 2, thereby pressing bricks 1 of a row against each other.

Figure 4:
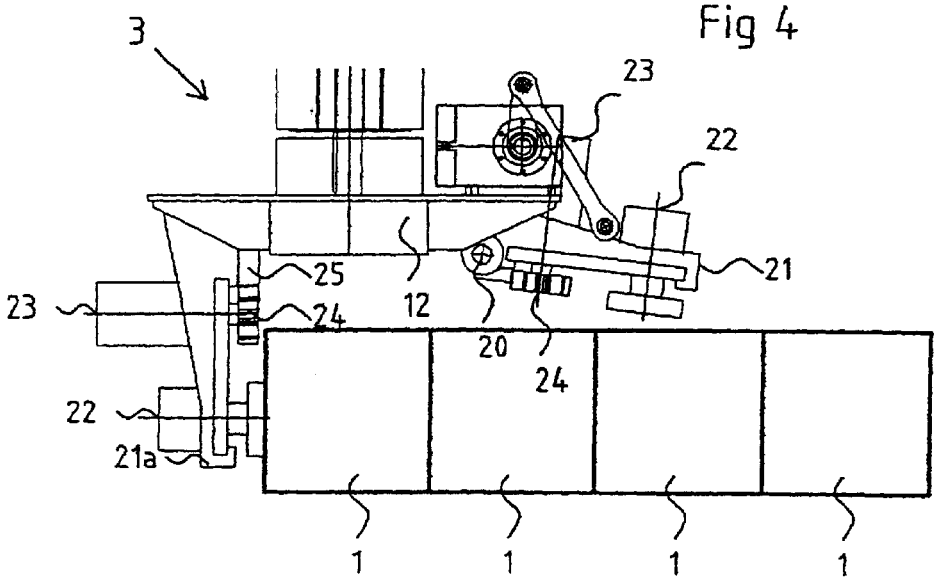
FIG. 4 shows a side view of the depiling gripper rotated by 90 degrees.

Between longitudinal grippers 13, 14, pairs of transverse grippers 21, 21*a* are provided, as shown in FIG. 4. The number of transverse gripper pairs 21, 21*a* is selected to be as great as the maximum number of bricks per row of brick pile 2. Transverse gripper pairs 21, 21*a* grip at right angles to the gripping direction of longitudinal grippers 13, 14. Transverse grippers 21 are likewise hinged to carrier 12 above bricks 1 to swivel about axle 20 and can be swiveled away upward so as not to collide with the brick rows on the pile not yet depiled when a brick row is gripped.

Bricks 1 of a whole brick row of brick pile 2 are picked up and gripped with longitudinal grippers 13, 14 and then regripped preferably in the air with transverse gripper pairs 21, 21*a*. Either all or only single bricks 1 of a row of brick pile 2 can be thereby deposited on line-up path 4.

Transverse gripper pairs 21, 21*a* are adapted to travel in the longitudinal direction, i.e. the gripping direction of longitudinal grippers 13, 14, in synchronism in pairs, so that the bricks gripped by transverse grippers 21, 21*a* can be pulled apart as soon as longitudinal grippers 13, 14 have been swiveled apart.

The traveling ability of transverse gripper pairs 21, 21*a* is shown by arrows 23. Transverse grippers 21, 21*a* are each driven individually by pinion 24 engaging rack 25 extending in the longitudinal direction of depiling gripper 3 and fastened to carrier 12.

The position of a gripped brick row can be displaced toward the center axis of depiling gripper 3. The actual position can be determined from measurement of the pivoting angle of longitudinal grippers 13, 14 about axles 15, 16. For depositing the gripped bricks, the target coordinates for depiling gripper 3 are corrected in accordance with the measured dimension. Transverse grippers 21, 21*a* are used to move apart bricks 1 of the brick row gripped by depiling gripper 3 to form joints 9 between bricks 1 of wall panels 8. A positioning device is provided for this purpose that moves apart the bricks of the brick row gripped by transverse grippers 21, 21*a* to the nominal length or width of the joint that the relevant brick row assumes in wall panel 8.

In the alternative application of the depiling gripper for walls with unmortared joints, the brick rows that are depiled from the pile are first pushed together with the longitudinal grippers, measured and then pulled apart again to a predetermined measure with the transverse grippers. Dimensional imperfections of the processed bricks due to brick tolerances are thus taken up in the vertical joints.

What is claimed is:

1. An apparatus for moving a row of bricks from a brick pile to a line-up path on which the row of bricks to be masoned are deposited, the apparatus comprising a longitudinal gripping device that depiles a row of bricks from a pile by two spaced longitudinal grippers that engage opposite ends of the brick row, and a separating device for longitudinally moving apart the bricks in the depiled row including transverse grippers disposed between said longitudinal grippers that individually hold the bricks of the brick row depiled with the longitudinal grippers.

2. The apparatus according to claim 1, further including a control device that longitudinally moves apart the longitudinal grippers to permit moving apart of the bricks in the brick row by the transverse grippers.

3. The apparatus according to claim 1, further including a measuring device that detects the distance between the longitudinal grippers for measuring the length of the depiled brick row and transfers the value to a control device.

4. The apparatus according to claim 1, further including a positioning device that moves apart the bricks of the brick row gripped by the transverse grippers to the nominal length of the brick row.

5. The apparatus according to claim 1, wherein the line-up path is formed by a conveyor.

6. The apparatus according to claim 1, wherein each said transverse gripper comprises a pair of opposing gripper jaws adapted to travel toward each other, and wherein a distance between said pair of gripper jaws is adjustable to adapt to different brick widths.

7. The apparatus according to claim 1, further comprising a carrier on which said longitudinal grippers are hingedly mounted to permit said longitudinal grippers to swivel on said carrier for engaging opposite ends of the brick row.

8. The apparatus according to claim 1, wherein each transverse gripper is formed by gripper pairs which engages the brick on opposite sides thereof.

9. The apparatus according to claim 1, wherein each transverse gripper is formed by a vacuum gripper for engaging the brick on one side thereof.

10. The apparatus according to claim 1, wherein a control device which permits regripping of the row of bricks from the longitudinal grippers to the transverse grippers and the longitudinal separation of the brick by the transverse grippers during movement of the brick row from the pile to the line-up path.

11. The apparatus according to claim 1, wherein said separating device has the same number of traverse grippers as the number of bricks in a pile row.

12. The apparatus according to claim 1, further including a transfer device for transporting the brick row from the line-up path to a bricklaying station for masoning the wall panel.

13. The apparatus according to claim 1, wherein said transverse grippers are formed to be movable in the longitudinal direction of said apparatus.

14. A method of moving a plurality of bricks from a first location to a second location, comprising the steps of:

securing a row of bricks residing in the first location with a pair of longitudinal grippers;

displacing said secured row of bricks from the first location to an intermediate location;

securing each individual brick within said row of bricks with a corresponding pair of transverse grippers;

releasing said longitudinal grippers from said row of bricks;

forming joint spaces between adjacent bricks making up said row of bricks by moving neighboring transverse grippers away from one another while maintaining an alignment of said row of bricks; and displacing said row of individually-secured bricks from said intermediate location to said second location and then effecting release of the row of bricks from said transverse grippers.

* * * * *